US009481011B2

(12) United States Patent
Halper

(10) Patent No.: US 9,481,011 B2
(45) Date of Patent: Nov. 1, 2016

(54) METHOD AND APPARATUS FOR ADDING DRY COLORANT TO LANDSCAPE MULCH FIBER

(71) Applicant: Mark N. Halper, Edison, NJ (US)

(72) Inventor: Mark N. Halper, Edison, NJ (US)

( * ) Notice: Subject to any disclaimer, the term of this patent is extended or adjusted under 35 U.S.C. 154(b) by 101 days.

(21) Appl. No.: 14/537,939

(22) Filed: Nov. 11, 2014

(65) Prior Publication Data

US 2015/0064351 A1 Mar. 5, 2015

(51) Int. Cl.

| | |
|---|---|
| ***B05C 15/00*** | (2006.01) |
| ***B05D 7/06*** | (2006.01) |
| ***B05B 7/14*** | (2006.01) |
| ***B05B 13/02*** | (2006.01) |
| *B05B 12/00* | (2006.01) |

(52) U.S. Cl.

CPC ..... *B05D 7/06* (2013.01); *B05B 7/1431* (2013.01); *B05B 13/0257* (2013.01); *B05B 12/006* (2013.01); *B05D 2258/00* (2013.01)

(58) Field of Classification Search

CPC . B65G 53/4633; B05B 13/0257; B07B 1/20; B07B 13/16; B05C 1/06; B05C 5/002; B05C 5/0208; B05C 9/12; B05D 7/06; C04B 41/4505

See application file for complete search history.

(56) References Cited

U.S. PATENT DOCUMENTS

| | | | | |
|---|---|---|---|---|
| 4,932,156 | A * | 6/1990 | Underwood | A01G 13/0262 47/9 |
| 6,726,133 | B2 * | 4/2004 | Hahn | B02C 13/18 241/1 |
| 7,381,271 | B2 * | 6/2008 | Farmwald | G05D 7/0605 118/303 |
| 7,878,431 | B2 * | 2/2011 | Blickley | B07B 1/20 222/170 |

FOREIGN PATENT DOCUMENTS

CN 202343290 U * 7/2012

* cited by examiner

*Primary Examiner* — Elena T Lightfoot
(74) *Attorney, Agent, or Firm* — Walter J. Tencza, Jr.

(57) ABSTRACT

An apparatus including an air blower; a rotary airlock; a receptacle having an inner chamber supplied with a plurality of colorant particles; a water supply; and a mixing chamber. The air blower blows air into a bottom section of the rotary airlock, and the rotary airlock receives colorant particles from an output of the receptacle. A rotor shaft of the rotary airlock rotates to cause colorant particles to be transported to the bottom section of the rotary airlock. Air blown into the bottom section of the rotary airlock mixes with colorant particles transported into the bottom section of the rotary airlock to form an air and colorant particles mixture, which is blown out of a first output of the rotary airlock and combined with water to form a water, air, and colorant particles mixture, which is mixed with material in a mixing chamber. The material may be natural mulch.

9 Claims, 4 Drawing Sheets

METHOD AND APPARATUS FOR ADDING DRY COLORANT TO LANDSCAPE MULCH FIBER

FIELD OF THE INVENTION

This invention relates to improved methods and apparatus concerning addition of dry powdered colorant to natural mulch fiber in a process known as color enhanced mulch production. Also known as the process of dyeing mulch fiber to produce a value added product that will retain color for a prolonged period of time.

BACKGROUND OF THE INVENTION

There are various devices known in the prior methodology for providing color enhanced mulch.

SUMMARY OF THE INVENTION

One or more embodiments of the present application combine several technologies that have heretofore not been combined to accurately, effectively and responsibly incorporate finely ground powdered ingredients into color enhanced mulch manufacturing. This combination of apparatus and process, in one or more embodiments, essentially removes risk of particulate contamination to the environment and increases workplace air quality safety.

One or more embodiments of the present invention use technologies that move dry colorant by way of an air stream, meters the dry colorant with the use of various apparatus, and combine with water. The combination of components in this invention results in delivery of an otherwise difficult colorant material to be incorporated into a natural mulch fiber with virtually no dust or risk to the environment. An apparatus, method, or system in accordance with one or more embodiments of the present invention can also be applied to materials other than natural mulch, such as stone, sand, shredded tires, and other materials.

In the present application natural mulch is mulch derived from trees and/or tree parts that are ground or shredded to a relatively small size and used in landscapes for, the purpose of protecting plants from weather and conservation of moisture.

One or more embodiments of the present invention provide an apparatus which will eliminate the need to liquefy mulch colorant by using various ingredients hence saving time, energy, transportation, process, and processing equipment. One or more embodiments of the present invention provide a process which will reduce carbon footprint and costs to color enhanced mulch manufacturers and end users while providing an inherent benefit to mankind.

One or more embodiments of the present application provide an apparatus comprising: an air blower having an output; a rotary airlock having a rotor shaft and a plurality of vanes fixed to the rotor shaft, wherein each pair of adjacent vanes of the plurality of vanes form a chamber; the rotary airlock further including a first input, a second input, a bottom section, and a first output; a receptacle having an input and an output, and having an inner chamber in which is located a plurality of colorant particles; a water supply having an output, and a mixing chamber having an input and an output.

The air blower may be configured to blow air out of its output and through the first input of the rotary airlock, into the bottom section of the rotary airlock. The rotary airlock may be configured to receive a portion of the plurality of colorant particles from the output of the receptacle at the second input of the rotary airlock, and the rotor shaft of the rotary airlock is configured to rotate to cause the portion of the plurality of colorant particles to be transported by a chamber of the rotary airlock from the second input of the rotary airlock to the bottom section of the rotary airlock.

The rotary airlock may be configured to allow the air blown into the bottom section of the rotary airlock to mix with the portion of the plurality of colorant particles transported into the bottom section of the rotary airlock to form an air and colorant particles mixture. The rotary airlock may be configured to cause the air and colorant particles mixture to be blown out of the first output of the rotary airlock. The output of the water supply may be configured so that water from the water supply is mixed with the air and colorant particles mixture from the first output of the rotary airlock to form a water, air, and colorant particles mixture. The mixing chamber may be configured to receive a material and the water, air, and colorant particles mixture at its input and to produce a mixture of the material and the water, air, and dry particles at its output.

The material may, for example, be natural mulch, stone, sand, or shredded tires. The apparatus may further include a means which controls the rotational speed of the rotor shaft of the rotary airlock to control the rate at which colorant particles of the plurality of colorant particles from the output of the receptacle are transported by one or more chambers of the rotary airlock from the second input of the rotary airlock to the bottom section of the rotary airlock. The means may include a variable frequency drive.

In at least one embodiment, a method is provided comprising the steps of: blowing air out of an output of an air blower and through a first input of a rotary airlock, into a bottom section of the rotary airlock; receiving a portion of a plurality of colorant particles from an output of a receptacle at a second input of the rotary airlock; rotating a rotor shaft of the rotary airlock to cause a portion of the plurality of colorant particles to be transported by a chamber of the rotary airlock from the second input of the rotary airlock to the bottom section of the rotary airlock; mixing the air blown into the bottom section of the rotary airlock with the portion of the plurality of colorant particles transported into the bottom section of the rotary airlock to form an air and colorant particles mixture; blowing the air and colorant particles mixture out of the first output of the rotary airlock; mixing water from a water supply with the air and colorant particles mixture from the first output of the rotary airlock to form a water, air, and colorant particles mixture; and receiving a material and the water, air, and colorant particles mixture at an input of a mixing chamber and producing a mixture of the material and the water, air, and dry particles at an output of the mixing chamber.

The material may be a material previously described. The method may further include controlling the rotational speed of the rotor shaft of the rotary airlock to control the rate at which colorant particles of the plurality of colorant particles from the output of the receptacle are transported by one or more chambers of the rotary airlock from the second input of the rotary airlock to the bottom section of the rotary airlock. The rotational speed of the rotor shaft of the rotary airlock may be controlled with a variable frequency drive.

DETAILED DESCRIPTION OF THE DRAWINGS

Figure 1:
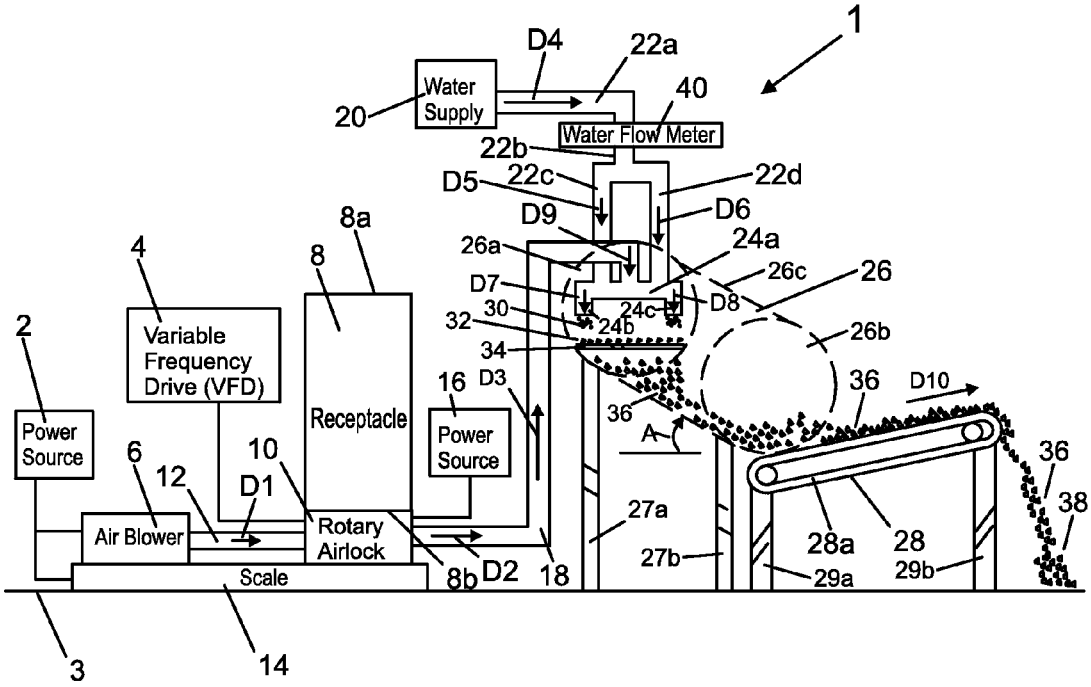
FIG. 1 shows a simplified diagram of an apparatus, system, and method in accordance with an embodiment of the present invention.

FIG. 1 shows a simplified diagram 1 of an apparatus, system, and method in accordance with an embodiment of the present invention. The diagram includes a power source 2, a variable frequency drive (VFD) 4, an air blower 6, a receptacle 8, a rotary airlock 10, piping 12, a digital scale 14, a power source 16, piping 18, a water supply 20, piping 22*a*, 22*b*, 22*c*, and 22*d* and piping 24*a*, 24*b*, and 24*c*, mixing chamber 26, conveyor device 28, a conveyor device 34, and a water flow meter 40. The water supply 20 may be located on the ground 3 and may include a water pump.

In operation, the air blower 6 is powered by the power source 2 to blow air in the direction D1 within the piping 12. The piping 12 may be cylindrical piping such as PVC (polyvinylchloride) (but not limited to) cylindrical piping. The air blower 6 may be positive displacement, high pressure, or medium pressure air displacing system or device or some other type of air displacing system or device. The power sources 2 and 16 may be electric, hydraulic, or mechanical.

The air from the air blower 6 flows through piping 12 and into a bottom section of rotary airlock 10. The receptacle 8 may be a cylindrical receptacle or hopper having an opening at top 8*a* and a bottom 8*b*. A dry powder colorant is placed in the receptacle 8 through the opening at the top 8*a*. The bottom 8*b* has an opening through which the dry powder colorant falls into a chamber of the rotary airlock 10. The rotary airlock 10 spins at a rate regulated and adjustable by the variable frequency drive 4. This causes measured quantities of the dry powder colorant to fall from a chamber, such as a chamber 11*b* shown in FIG. 2 of the rotary airlock 10 into the bottom section 11*c* after the rotor shaft 10*i* of the rotary airlock 10 rotates. The variable frequency drive 4 may be replaced by another means to drive and/or regulate the speed of the rotor shaft 10*i* of the rotary airlock 10, or of other drived components.

Figure 2:
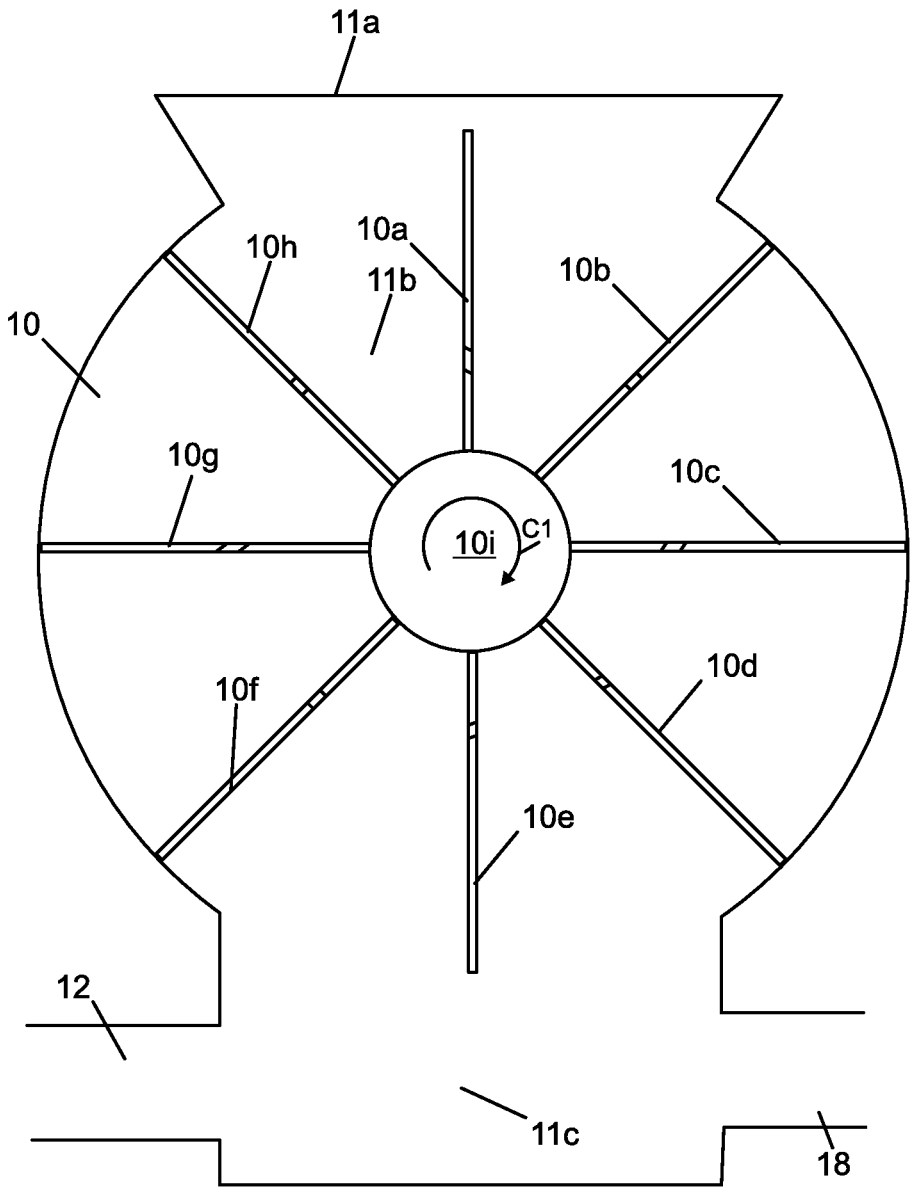
FIG. 2 shows a simplified diagram of a rotary airlock for use with the apparatus, system and method of FIG. 1.

FIG. 2 shows a simplified diagram of the rotary airlock 10 for use with the apparatus, system and method of FIG. 1. The dry powder colorant falls through an opening 8*b* in the receptacle 8 through the opening 11*a* into chamber 11*b* and/or one of the other chambers between vanes or fins 10*a*-10*h*, and then as the shaft 10*i* rotates the dry powder colorant falls into bottom section 11*c*, and mixes with air from piping 12 and the mixture of air and dry powder colorant flows into piping 18.

The rotary air lock 10 may alternately be driven by a hydraulic motor and a hydraulic valve which may be part of the rotary air lock 10 to limit the flow of dry powder colorant through the bottom section of the rotary airlock 10.

The portions of the dry powder colorant falling into the bottom section of the rotary airlock 10 mix with the air from the piping 12 in the bottom section of the rotary airlock 10. The air and dry powder colorant flow from the bottom section of the rotary airlock 10 into the piping 18, in the direction D2, then in the direction D3, and thereafter in the direction D9 into the piping 24*a*. The piping 12 through which air flows may be at a ninety degree angle or some other angle with respect to the piping 18 although pipings 12 and 18 are shown in line in FIG. 2.

The water supply 20 supplies water flowing in the direction D4 into the piping 22*a*. The water then flows into water flow meter 40 which measures the flow of the water to enable the operator to have the ability to monitor and adjust the quantity of water dispatched onto the mulch. Addition of water is extremely critical to the finished product. Too much water results in an over hydrated product and too little water prevents colorant absorption in the final mix. Often times the natural mulch ingredient varies in moisture, depending on conditions such as: season, weather, source of material to be colored, age of mulch etc. Therefore it is important for an operator to know exactly the quantity of water dispensed in order to react effectively. The operator can examine the water flow meter 40 which may indicate on a display, for example, the number of gallons of water per minute that flow through the water flow meter 40, from piping 22*a* to piping 22*b*. The operator can control the water supply 20 to reduce the flow of water from the water supply 20 into the piping 22*a*, upon seeing that the flow rate of water is too high or too low. Alternatively, or additionally, the water flow meter 40 may include a computer processor and the water supply 20 may include a computer processor, and these two (or more) computer processors may communicate, such as wirelessly. The flow rate of water through the water flow meter 40 may automatically change the flow rate supplied by the water supply 20, such as increase or decrease, as programmed into a computer memory stored in the water flow meter 40 or elsewhere.

The water flows out of flow meter 40 and into piping 22*b*. The flow of water into the piping 22*b* then branch into two branches, the branch or piping 22*c* and the branch or piping 22*d*. The two branches or flows of water, then flow in the directions D5 and D6, into piping 24*a* where they mix with the air and dry powder colorant combinant. An air, water, and dry powder colorant mixture then flows out of an opening in piping 24*b* and out of an opening in piping 24*c* as a plurality of particles 30, into mixing chamber 26 through opening 26*a*. At the same time, a plurality of particles 32 of material, such as natural mulch fiber is fed into mixing chamber 26 through the opening 26*a* via the conveyor device 34. The conveyor device 34 may include or may work with further components which are not shown for simplification in FIG. 1. The conveyor device 34 may include a conveyor belt or auger. The conveyor device 34 may be set to a particular speed or to a variable speed to feed natural mulch particles 32 into the mixing chamber 26 through the opening 26*a*. The natural mulch and the air, water, and colorant mixture, then flow through the mixing chamber 26 for a set time, combine, and become a homogeneous mixture of mulch, air, water, and colorant. The homogenous mixture may include a plurality of particles 36. A finished product of the plurality of particles 36 flow out the opening 26*b*, and then the plurality of particles 36 falls onto conveyor belt 28*a* of the conveyor device 28. The conveyor belt 28*a* then moves the plurality of particles 36 or finished product in the direction D10 until the particles 36 drop off the conveyor belt 28*a* into a stock pile 38 on a ground surface 3.

The plurality of particles of material 32 may be a material other than natural mulch, such as for example, stone, sand, shredded tires or other materials.

The mixing chamber 26 is shown in dashed lines as transparent so that the various particles 30, 32, and 36 can be seen in FIG. 1, but in reality may be a solid cylinder having a cylindrical wall 26*c* and openings 26*a*, and 26*b*.

The receptacle 8, the rotary airlock 10, and the air blower 6 may rest on a digital or analog weighing scale 14 which may rest on the ground surface 3. The scale 14 is used to determine the weight of the amount of dry powder colorant in the receptacle 8 (after subtracting weight of air blower 6, rotary airlock 10, and receptacle 8, and any other components on the scale 14, other than powder colorant). The data from scale is used to calculate speed at which airlock will operate in order to determine the desired amount of dry powder colorant being combined with mulch fiber. The quantity of colorant dispensed is at the discretion of the operator. Some operators may desire a darker, richer final product and some may require a less vibrant product. The different results are entirely up to the operator and adjustable by regulating one or more functions of the apparatus and process.

The mixing chamber 26 may be configured at an angle A with respect to the ground surface 3 and the mixing chamber 26 may be supported by supports 27*a* and 27*b*. The conveyor device 28 may be supported by supports 29*a* and 29*b*, and may be inclined upwards with respect the ground surface 3. The angle A may be set at an operator's discretion but may be between five and thirty-five degrees and should be sufficient enough to allow the particles 36 to fall through the mixing chamber 26 through opening 26*b* onto conveyor belt 28*a*.

The mixing chamber 26 may be any known mixing chamber, such as for example a known modified Trommel screen. In accordance with one or more embodiments of the present invention, the mixing chamber 26 may include or may be replaced by other currently known methods and apparatus of combining liquid colorant to mulch. For example, the mixing chamber 26 may include or may be replaced by a tub grinder, a horizontal grinder, and/or a batch or continuous flow mixing apparatus and/or method.

One or more embodiments of the present invention have the advantage that little to no dust from the particles 36 or finished product 36 becomes airborne. The size of particles in the dry ingredient stored inside the receptacle 8 are typically in the fifteen to one hundred nanometer range and have a propensity to create clouds and mix with the environment when not handled properly. By using one or more devices and methods described herein in the present application, the risk of incorporating dust clouds and introducing particulates into the air are diminished to near zero, for the finished product or particles 36 shown in FIG. 1 in pile 38.

Figure 3:
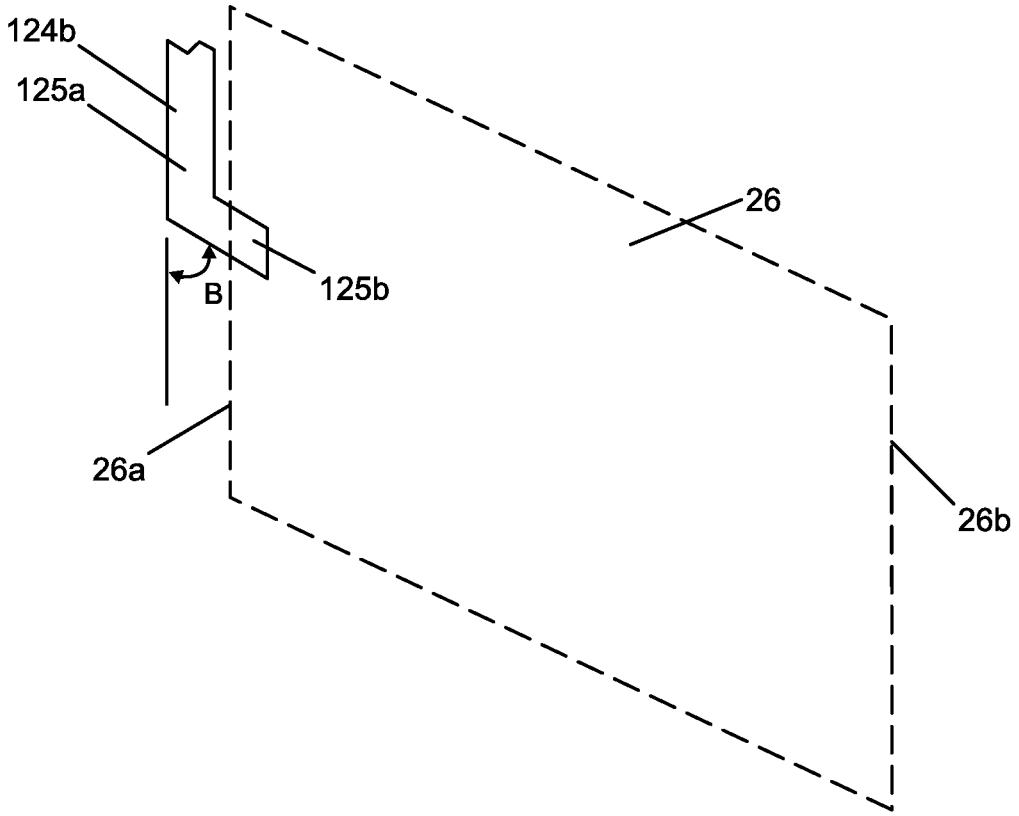
FIG. 3 shows a simplified diagram of side view of alternative piping for use with the apparatus, system, and method of FIG. 1.

FIG. 3 shows a simplified diagram of a side view of alternative piping for use with the apparatus, system, and method of FIG. 1. The alternative piping includes piping 124*b*. The piping 124*b* includes a section 125*a* and 125*b*. The section 125*b* may be at an angle B with respect to the section 125*a*. The angle may be between fifteen and ninety degrees. The piping 124*b* may replace be used for or instead of piping 24*b* in FIG. 1. The piping 124*b* or identical or analogous piping may also be used for piping 24*c*. The angle of section 125*b* with respect to section 125*a* helps to insert the air dry particle mixture into the mixing chamber 26.

Figure 4:
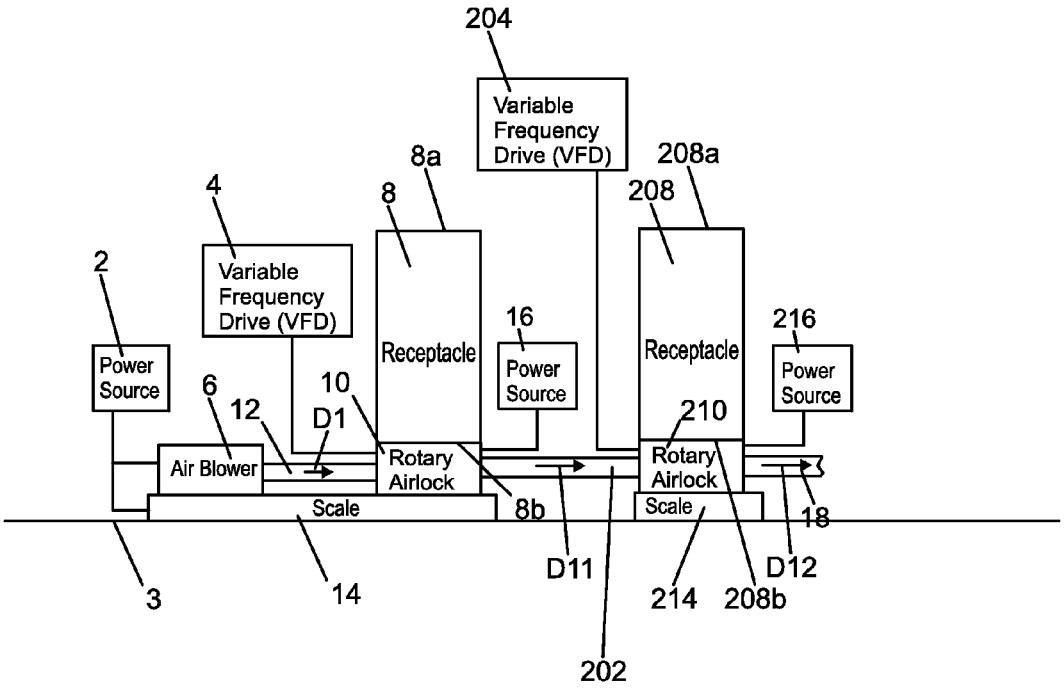
FIG. 4 shows a simplified diagram of an part of an embodiment of the present invention where two receptacles and two airlocks are used.

FIG. 4 shows a simplified block diagram of a part of an embodiment of the present invention where two receptacles and two airlocks are used. FIG. 4 shows power sources 2, 16, and 216, air blower 6, variable frequency drives 4 and 204, receptacles 8 and 208, rotary airlocks 10 and 210, and scales 14 and 214. The receptacles 8 and 208 may be identical. The rotary airlocks 10 and 210 may be identical. The scales 14 and 214 may be identical.

Part of the piping 18 of FIG. 1 is shown in FIG. 4. The part of the piping 18 shown in FIG. 4 may be connected to the rest of the piping 18 shown in FIG. 1, so that effectively, the power source 216, variable frequency drive 204, receptacle 208, rotary airlock 210, and scale 214 are inserted into the FIG. 1 apparatus, system and method, to change the FIG. 1 embodiment of a two rotary airlock embodiment. in operation, of the embodiment of FIG. 1, altered by FIG. 4, air blows from the air blower into piping 12 in direction D1 into the bottom section of the airlock 10. The receptacle 8 contains a first color of dry colorant particles such as black. The variable frequency drive 4 controls a rate of delivery of the first colored dry colorant to the bottom section of the rotary airlock 10. An air and first colored dry colorant mixture is then blow into piping 202. The receptacle 208 has located therein a second color of dry colorant particles. The air and first colored dry colorant particles blow into the bottom section of airlock 210, and mix with the second colored dry colorant particles falling through the bottom 208*b* of the receptacle 208 at a rate determined by the variable frequency drive 204. A mixture of the air and the first colored dry colorant particles and the second colored dry colorant particles are then blow into piping 18 and processed by the apparatus and process after piping 18 as previously referred to with reference to FIG. 1.

The mixture of air and first colored dry powder colorant (such as colored black) and second colored dry powder colorant (such as colored red) flow from the bottom section of the rotary airlock 10 into the piping 18, in the direction D2, then in the direction D3, and thereafter in the direction D9 into the piping 24*a*. The water supply 20 supplies water flowing in the direction D4 into the piping 22*a*. The water flows out of flow meter 40 and into piping 22*b*. The flow of water into the piping 22*b* then branch into two branches, the branch or piping 22*c* and the branch or piping 22*d*. The two branches or flows of water, then flow in the directions D5 and D6, into piping 24*a* where they mix with the air and first and second colored dry powder colorant combinant. An air, water, and first and second dry powder colorant mixture then flows out of an opening in piping 24*b* and out of an opening in piping 24*c* as a plurality of particles 30, into mixing chamber 26 through opening 26*a*. At the same time, a plurality of particles 32 of material, such as natural mulch fiber is fed into mixing chamber 26 through the opening 26*a* via the conveyor device 34. The natural mulch and the air, water, and first and second colorant mixture, then flow through the mixing chamber 26 for a set time, combine, and become a homogeneous mixture of mulch, air, water, and first and second dry colorant. The homogenous mixture may include a plurality of particles 36. A finished product of the plurality of particles 36 flow out the opening 26*b*, and then the plurality of particles 36 falls onto conveyor belt 28*a* of the conveyor device 28. The conveyor belt 28*a* then moves the plurality of particles 36 or finished product in the direction D10 until the particles 36 drop off the conveyor belt 28*a* into a stock pile 38 on a ground surface 3.

The receptacle 208, and the rotary airlock 210, may rest on a digital or analog weighing scale 214 which may rest on the ground surface 3. The scale 14 is used to determine the weight of the amount of first colored dry powder colorant in the receptacle 8 (after subtracting weight of air blower 6, rotary airlock 10, and receptacle 8, and any other components on the scale 14, other than powder colorant), and the second scale 214 is used to determine the weight of the amount of second colored dry powder colorant in the receptacle 208 (after substracting for other components as necessary). The data from the scales 14 and 214 may be used to calculate speed at which airlocks 10 and 210 will operate in order to determine the desired amount of first colored and second colored dry powder colorant, respectively, being combined with mulch fiber. The quantity of first colored colorant and second colored colorant dispensed is at the discretion of the operator.

In at least one embodiment, the configuration of FIG. 4 can be provided in conjunction with the other components including piping 18 and components after piping 18 in the flow of the process. In such an embodiment, the variable frequency drive 4 can control the rotary airlock 10 so that no first colored dry colorant from receptacle 8 is delivered to the bottom section of rotary airlock 10 through bottom opening 8*b*. In that case, air, with no first colored dry colorant, will blow through the bottom section of the rotary airlock 10, from the piping 12 to the piping 202. The air will then mix with second colored dry colorant from the rotary airlock 210, and a mixture of air and second colored dry colorant will be delivered to piping 18, without any first colored dry colorant.

Similarly, in at least one embodiment, the variable frequency drive 204 can control the rotary airlock 210 so that no second colored dry colorant from receptacle 208 is delivered to the bottom section of rotary airlock 210 through bottom opening 208*b*. In that case, air mixed with first colored dry colorant, will blow through the bottom section of the rotary airlock 210, from the piping 202 to the piping 18, without any second colored dry colorant.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprising the steps of:

blowing air out of an output of an air blower and through a first input of a first rotary airlock, into a bottom section of the first rotary airlock;

receiving a portion of a plurality of first colored colorant particles from an output of a first receptacle at a second input of the first rotary airlock;

rotating a rotor shaft of the first rotary airlock to cause a portion of the plurality of first colored colorant particles to be transported by a chamber of the first rotary airlock from the second input of the first rotary airlock to the bottom section of the first rotary airlock;

mixing the air blown into the bottom section of the first rotary airlock with the portion of the plurality of first colored colorant particles transported into the bottom section of the first rotary airlock to form an air and first colored colorant particles mixture;

blowing the air and first colored colorant particles mixture out of the first output of the first rotary airlock;

mixing water from a water supply with the air and first colored colorant particles mixture from the first output of the first rotary airlock to form a water, air, and first colored colorant particles mixture; and receiving a material and the water, air, and first colored colorant particles mixture at an input of a mixing chamber and producing a mixture of the material and the water, air, and first colored colorant particles at an output of the mixing chamber; and wherein the air and first colored colorant particles mixture is supplied to a first inlet of a pipe;

wherein the water supply provides water in at least first and second branches;

wherein the first branch of the water from the water supply is supplied to a second inlet of the pipe, wherein the second branch of the water from the water supply is supplied to a third inlet of the pipe;

wherein the first inlet of the pipe is between the second and the third inlets of the pipe;

and wherein the first and the second branches of the water from the water supply mix with the air and first colored colorant particles mixture in the pipe to form the water, air, and first colored colorant particles mixture.

2. A method comprising the steps of:

blowing air out of an output of an air blower and through a first input of a first rotary airlock, into a bottom section of the first rotary airlock;

receiving a portion of a plurality of first colored colorant particles from an output of a first receptacle at a second input of the first rotary airlock;

rotating a rotor shaft of the first rotary airlock to cause a portion of the plurality of first colored colorant particles to be transported by a chamber of the first rotary airlock from the second input of the first rotary airlock to the bottom section of the first rotary airlock;

mixing the air blown into the bottom section of the first rotary airlock with the portion of the plurality of first colored colorant particles transported into the bottom section of the first rotary airlock to form an air and first colored colorant particles mixture;

blowing the air and first colored colorant particles mixture out of the first output of the bottom section of the first rotary airlock and into a first input of a second rotary airlock;

receiving a portion of a plurality of second colored colorant particles from an output of a second receptacle at a second input of the second rotary airlock;

rotating a rotor shaft of the second rotary airlock to cause a portion of the plurality of second colored colorant particles to be transported by a chamber of the second rotary airlock from the second input of the second rotary airlock to the bottom section of the second rotary airlock;

mixing the air and first colored colorant particles blown into the bottom section of the second rotary airlock with the portion of the plurality of second colored colorant particles transported into the bottom section of the second rotary airlock to form an air and first and second colored colorant particles mixture;

blowing the air and first and second colored colorant particles mixture out of the first output of the second rotary airlock;

mixing water from a water supply with the air and first and second colored colorant particles mixture from the first output of the second rotary airlock to form a water, air, and first and second colored colorant particles mixture; and receiving a material and the water, air, and first and second colored colorant particles mixture at an input of a mixing chamber and producing a mixture of the material and the water, air, and first and second colored colorant particles at an output of the mixing chamber; and wherein the air and first and second colored colorant particles mixture is supplied to a first inlet of a pipe;

wherein the water supply provides water in at least first and second branches;

wherein the first branch of the water from the water supply is supplied to a second inlet of the pipe, wherein the second branch of the water from the water supply is supplied to a third inlet of the pipe;

wherein the first inlet of the pipe is between the second and the third inlets of the pipe;

and wherein the first and the second branches of the water from the water supply mix with the air and first and second colored colorant particles mixture in the pipe to form the water, air, and first and second colored colorant particles mixture.

3. The method of claim 1 wherein the material is stone.

4. The method of claim 1 wherein the material is sand.

5. The method of claim 1 wherein the material is shredded tires.

6. The method of claim 1 further comprising controlling the rotational speed of the rotor shaft of the first rotary airlock to control the rate at which first colored colorant particles of the plurality of first colored colorant particles from the output of the first receptacle are transported by one or more chambers of the first rotary airlock from the second input of the first rotary airlock to the bottom section of the first rotary airlock.

7. The method of claim 6 wherein the rotational speed of the rotor shaft of the first rotary airlock is controlled with a first variable frequency drive.

8. The method of claim 2 further comprising controlling the rotational speed of the rotor shaft of the first rotary airlock to control the rate at which first colored colorant particles of the plurality of first colored colorant particles from the output of the first receptacle are transported by one or more chambers of the first rotary airlock from the second input of the first rotary airlock to the bottom section of the first rotary airlock; and controlling the rotational speed of the rotor shaft of the second rotary airlock to control the rate at which second colored colorant particles of the plurality of second colored colorant particles from the output of the second receptacle are transported by one or more chambers of the second rotary airlock from the second input of the second rotary airlock to the bottom section of the second rotary airlock.

9. The method of claim 8 wherein the rotational speed of the rotor shaft of the first rotary airlock is controlled with a first variable frequency drive; and wherein the rotational speed of the rotor shaft of the second rotary airlock is controlled with a second variable frequency drive.

* * * * *